US006490768B1

(12) United States Patent
Goodall

(10) Patent No.: US 6,490,768 B1
(45) Date of Patent: Dec. 10, 2002

(54) TOWEL FASTENER FOR A LOUNGE CHAIR

(76) Inventor: Robert M. Goodall, 7932 Calle San Felipe, Carlsbad, CA (US) 92009

( * ) Notice: Subject to any disclaimer, the term of this patent is extended or adjusted under 35 U.S.C. 154(b) by 0 days.

(21) Appl. No.: 09/939,040

(22) Filed: Aug. 24, 2001

(51) Int. Cl.[7] ..... A44B 21/00
(52) U.S. Cl. ..... 24/334; 24/510; 24/339
(58) Field of Search ..... 24/334, 338, 339, 24/502, 507, 508, 509, 510; 132/276, 279; 248/316.5, 316.7

(56) References Cited

U.S. PATENT DOCUMENTS

| | | | | | |
|---|---|---|---|---|---|
| 510,468 | A | | 12/1893 | Buehl | |
| 561,376 | A | * | 6/1896 | Crawford | 24/510 X |
| 1,638,979 | A | * | 8/1927 | Broking | 24/507 |
| 2,603,849 | A | * | 7/1952 | Epperson | 24/507 |
| D298,711 | S | | 11/1988 | Lowance | |
| 4,858,285 | A | | 8/1989 | Dala et al. | |
| 4,993,126 | A | | 2/1991 | Collins | |
| 5,584,456 | A | | 12/1996 | Stephens | |
| 5,611,123 | A | * | 3/1997 | Prizzi | 24/459 |
| 5,829,832 | A | | 11/1998 | Molee et al. | |
| 5,960,520 | A | * | 10/1999 | Conway et al. | 24/306 |

* cited by examiner

*Primary Examiner*—Robert J. Sandy

(57) ABSTRACT

A towel fastener for a lounge chair for holding beach towels, in particular, firmly in place upon lounge chairs. The towel fastener for a lounge chair includes a clip support member being adapted to be mounted about a portion of a lounge chair and having a main tubular portion and a handle portion extending outwardly from the main tubular portion; and also includes a clip member being pivotally attached to the clip support member and having an curved fastening portion which is pivotally disposed about the main tubular portion and also having a handle portion; and further includes a biasing assembly being connected to the clip support member and to the clip member for biasing the curved fastening portion of the clip member upon the tubular portion of the clip support member.

8 Claims, 2 Drawing Sheets

TOWEL FASTENER FOR A LOUNGE CHAIR

BACKGROUND OF THE INVENTION

1. Field of the Invention

The present invention relates to towel fasteners for chairs and more particularly pertains to a new towel fastener for a lounge chair for holding beach towels, in particular, firmly in place upon lounge chairs.

2. Description of the Prior Art

The use of towel fasteners for chairs is known in the prior art. More specifically, towel fasteners for chairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,584,456; U.S. Pat. No. 5,829,832; U.S. Pat. No. Des. 298,711; U.S. Patent No. 510,468; U.S. Pat. No. 4,993,126; and U.S. Pat. No. 4,858,285.

While these devices fulfill their respective, particular objectives and requirements, the aforementioned patents do not disclose a new towel fastener for a lounge chair. The inventive device includes a clip support member being adapted to be mounted about a portion of a lounge chair and having a main tubular portion and a handle portion extending outwardly from the main tubular portion; and also includes a clip member being pivotally attached to the clip support member and having an curved fastening portion which is pivotally disposed about the main tubular portion and also having a handle portion; and further includes a biasing assembly being connected to the clip support member and to the clip member for biasing the curved fastening portion of the clip member upon the tubular portion of the clip support member.

In these respects, the towel fastener for a lounge chair according to the present invention substantially departs from the conventional concepts and designs of the prior art, and in so doing provides an apparatus primarily developed for the purpose of holding beach towels, in particular, firmly in place upon lounge chairs.

SUMMARY OF THE INVENTION

In view of the foregoing disadvantages inherent in the known types of towel fasteners for chairs now present in the prior art, the present invention provides a new towel fastener for a lounge chair construction wherein the same can be utilized for holding beach towels, in particular, firmly in place upon lounge chairs.

The general purpose of the present invention, which will be described subsequently in greater detail, is to provide a new towel fastener for a lounge chair apparatus and method which has many of the advantages of the towel fasteners for chairs mentioned heretofore and many novel features that result in a new towel fastener for a lounge chair which is not anticipated, rendered obvious, suggested, or even implied by any of the prior art towel fasteners for chairs, either alone or in any combination thereof.

To attain this, the present invention generally comprises a clip support member being adapted to be mounted about a portion of a lounge chair and having a main tubular portion and a handle portion extending outwardly from the main tubular portion; and also includes a clip member being pivotally attached to the clip support member and having an curved fastening portion which is pivotally disposed about the main tubular portion and also having a handle portion; and further includes a biasing assembly being connected to the clip support member and to the clip member for biasing the curved fastening portion of the clip member upon the tubular portion of the clip support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new towel fastener for a lounge chair apparatus and method which has many of the advantages of the towel fasteners for chairs mentioned heretofore and many novel features that result in a new towel fastener for a lounge chair which is not anticipated, rendered obvious, suggested, or even implied by any of the prior art towel fasteners for chairs, either alone or in any combination thereof.

It is another object of the present invention to provide a new towel fastener for a lounge chair which may be easily and efficiently manufactured and marketed.

It is a further object of the present invention to provide a new towel fastener for a lounge chair which is of a durable and reliable construction.

An even further object of the present invention is to provide a new towel fastener for a lounge chair which is susceptible of a low cost of manufacture with regard to both materials and labor, and which accordingly is then susceptible of low prices of sale to the consuming public, thereby making such towel fastener for a lounge chair economically available to the buying public.

Still yet another object of the present invention is to provide a new towel fastener for a lounge chair which provides in the apparatuses and methods of the prior art some of the advantages thereof, while simultaneously overcoming some of the disadvantages normally associated therewith.

Still another object of the present invention is to provide a new towel fastener for a lounge chair for holding beach towels, in particular, firmly in place upon lounge chairs.

Yet another object of the present invention is to provide a new towel fastener for a lounge chair which includes a clip support member being adapted to be mounted about a portion of a lounge chair and having a main tubular portion and a handle portion extending outwardly from the main tubular portion; and also includes a clip member being pivotally attached to the clip support member and having an curved fastening portion which is pivotally disposed about the main tubular portion and also having a handle portion; and further includes a biasing assembly being connected to the clip support member and to the clip member for biasing the curved fastening portion of the clip member upon the tubular portion of the clip support member.

Still yet another object of the present invention is to provide a new towel fastener for a lounge chair that is easy and convenient to use.

Even still another object of the present invention is to provide a new towel fastener for a lounge chair that prevents the user's towel from being blown off the lounge chair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
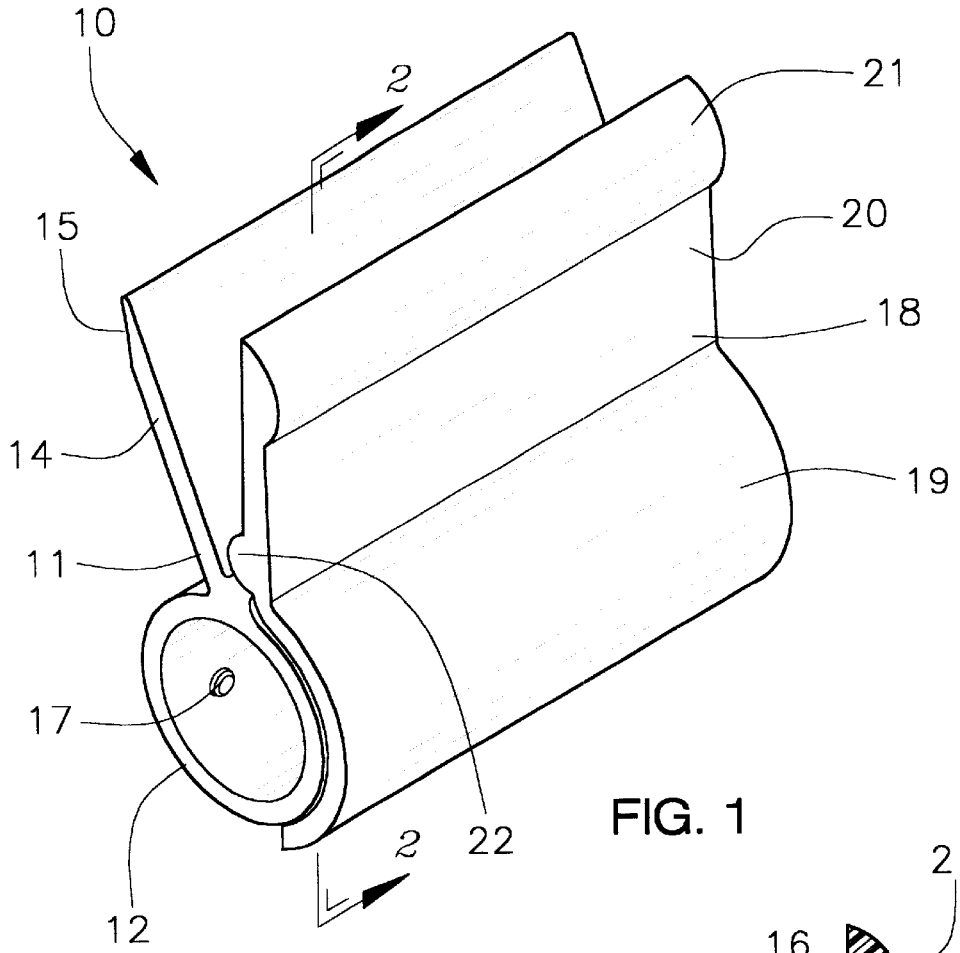
FIG. 1 is a perspective view of a new towel fastener for a lounge chair according to the present invention.
Figure 2:
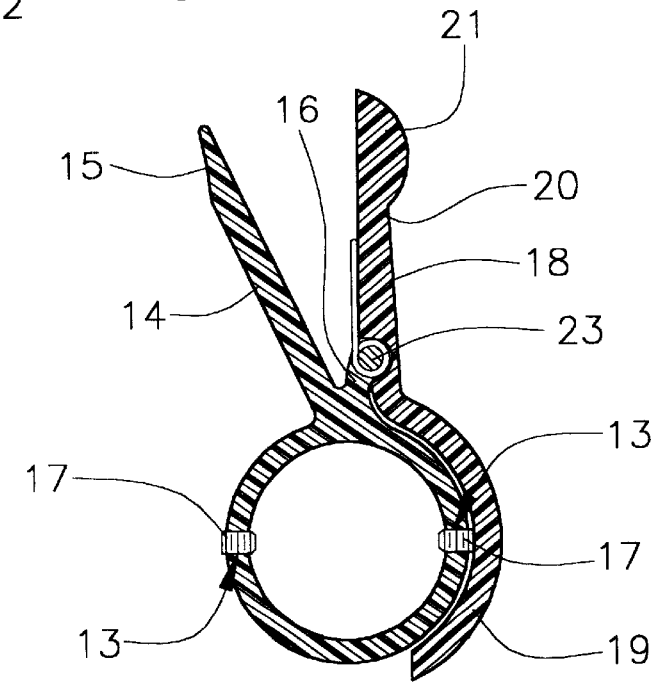
FIG. 2 is a cross-sectional view of the present invention.
Figure 3:
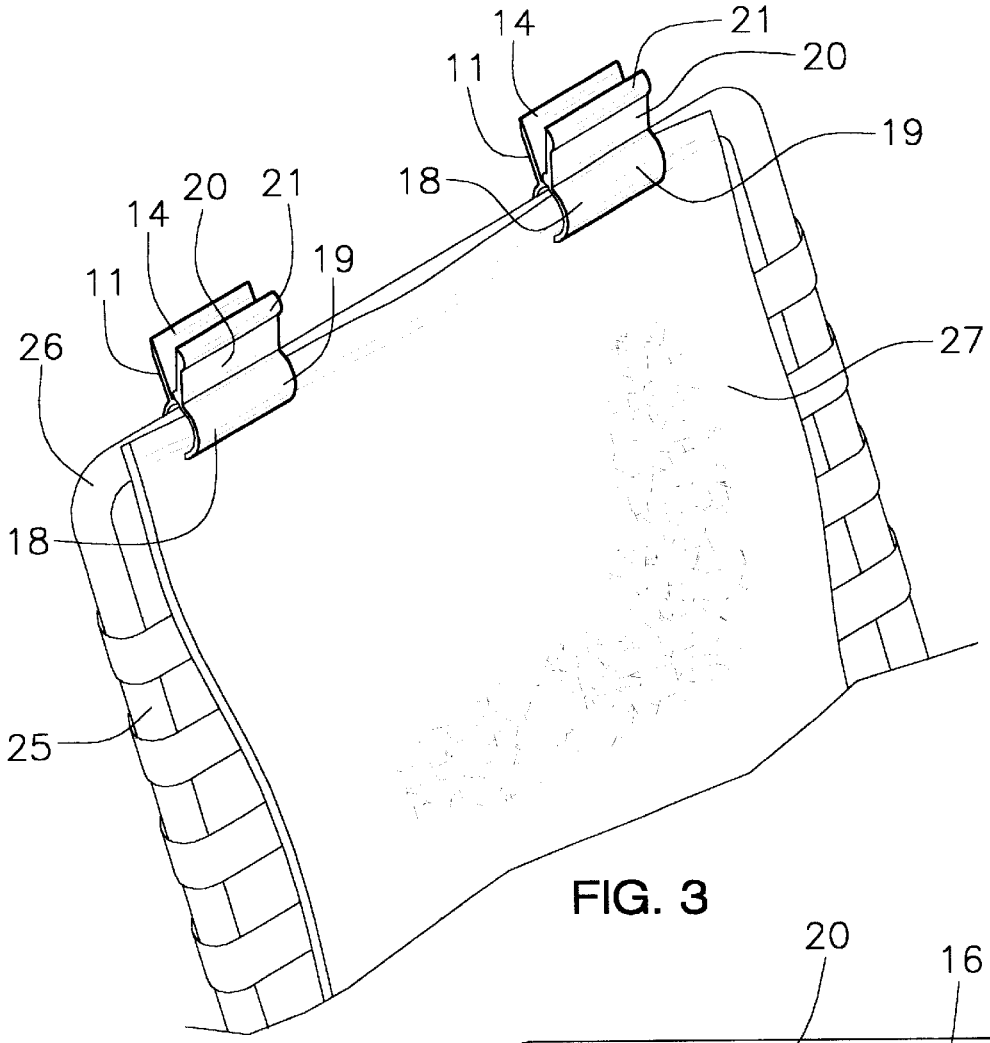
FIG. 3 is a perspective view of the present invention shown in use.
Figure 4:
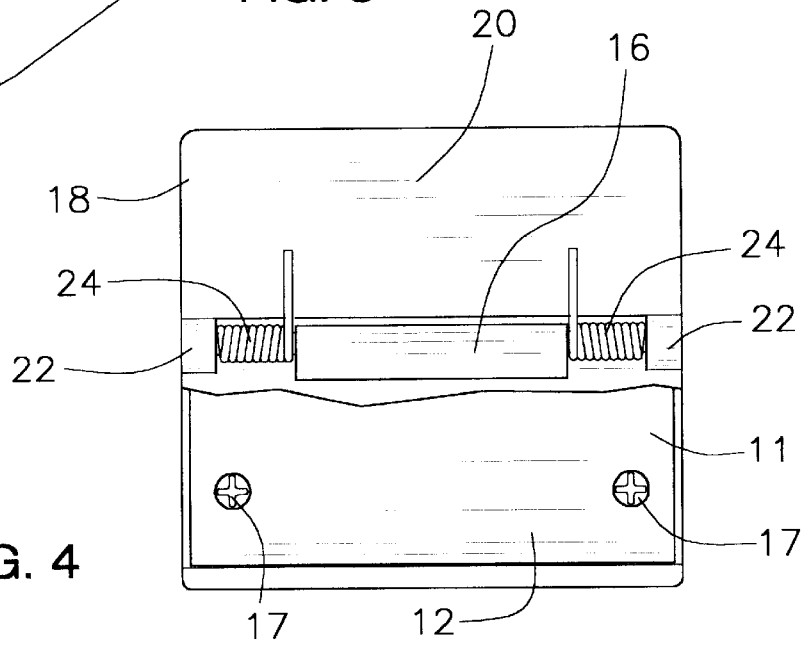
FIG. 4 is a side elevational view of the present invention.

With reference now to the drawings, and in particular to FIGS. 1 through 4 thereof, a new towel fastener for a lounge chair embodying the principles and concepts of the present invention and generally designated by the reference numeral 10 will be described.

As best illustrated in FIGS. 1 through 4, the towel fastener for a lounge chair 10 generally comprises a clip support member 11 being adapted to be mounted about a portion of a lounge chair 15 and having a main tubular portion 12 and a handle portion 14 integrally extending outwardly from the main tubular portion 12. The main tubular portion 12 of the clip support member 11 has holes 13 disposed through a wall thereof and is adapted to be securely fastened with fastening members 17 about a cross member 26 of the lounge chair 25. The clip support member 11 further includes a second tubular portion 16 being securely and integrally attached to an exterior of the wall of the main tubular portion 12 and having a longitudinal axis which is disposed parallel to a longitudinal axis of the main tubular portion 12. The secondary tubular portion 16 is disposed adjacent to the handle portion 14 of the clip support member 11. The handle portion 14 of the clip support member being a plate being angled relative to the secondary tubular portion 16 and having a tapered outer end 15.

A clip member 18 is pivotally and conventionally attached to the clip support member 11 and has a curved fastening portion 19 which is pivotally disposed about the main tubular portion 12 and also has a handle portion 20. The clip member 18 further includes lug members 22 being spaced apart and being integrally attached at a bottom end of the handle portion 20 of the clip member 18. The handle portion 20 of the clip member 18 is a plate having an enlarged outer end 21 with a planar first side and a bulbous second side.

A biasing assembly is conventionally connected to the clip support member 11 and to the clip member 18 for biasing the curved fastening portion 19 of the clip member 18 upon the main tubular portion 12 of the clip support member 11. The biasing assembly includes at least one shaft 23 being disposed through the secondary tubular portion 16 and in the lug members 22, and also includes spring members 24 being conventionally disposed about the at least one shaft 23 and being engaged to the handle portion 20 of the clip member 18 for biasing the curved fastening portion 19 about the main tubular portion 12 to hold a portion of a towel 27 therebetween.

In use, the user squeezes the two handle portions 14, 18 together to urge the curved fastening portion 19 away from the main tubular portion 12, and places a portion of the towel between the main tubular portion 12 and the curved fastening portion 19, and then releases the handle portion 14, 18 thus allowing the spring members 24 to move the curved fastening portion 19 into engagement with the towel 27 and the main tubular portion 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A towel fastener for a lounge chair comprising:

a clip support member being adapted to be mounted about a portion of a lounge chair and having a main tubular portion and a handle portion extending outwardly from said main tubular portion;

a clip member being pivotally attached to said clip support member and having a curved fastening portion which is pivotally disposed about said main tubular portion and also having a handle portion; and a biasing assembly being connected to said clip support member and to said clip member for biasing said curved fastening portion of said clip member upon said main tubular portion of said clip support member.

2. A towel fastener for a lounge chair as described in claim 1, wherein said main tubular portion of said clip support member has holes disposed through a wall thereof and is adapted to be securely fastened with fastening members about a cross member of the lounge chair.

3. A towel fastener for a lounge chair as described in claim 1, wherein said clip support member further includes a secondary tubular portion being securely attached to an exterior of said wall of said main tubular portion and having a longitudinal axis which is disposed parallel to a longitudinal axis of said main tubular portion, said secondary tubular portion being disposed adjacent to said handle portion of said clip support member.

4. A towel fastener for a lounge chair as described in claim 3, wherein said handle portion of said clip support member is a plate being angled relative to said secondary tubular portion and having a tapered outer end.

5. A towel fastener for a lounge chair as described in claim 3, wherein said clip member further includes lug members being spaced apart and being attached at a bottom end of said handle portion of said clip member.

6. A towel fastener for a lounge chair as described in claim 5, wherein said handle portion of said clip member is a plate having an enlarged outer end with a planar first side and a bulbous second side.

7. A towel fastener for a lounge chair as described in claim 5, wherein said biasing assembly includes at least one shaft being disposed through said second tubular portion and in said lug members, and also includes spring members being disposed about said at least one shaft and being engaged to said handle portion of said clip member for biasing said curved fastening portion about said main tubular portion to hold a portion of a towel therebetween.

8. A towel fastener for a lounge chair comprising:

a clip support member being adapted to be mounted about a portion of a lounge chair and having a main tubular portion and a handle portion extending outwardly from said main tubular portion, said main tubular portion of said clip support member having holes disposed through a wall thereof and is adapted to be securely fastened with fastening members about a cross member of the lounge chair, said clip support member further including a secondary tubular portion being securely attached to an exterior of said wall of said main tubular portion and having a longitudinal axis which is disposed parallel to a longitudinal axis of said main tubular portion, said secondary tubular portion being disposed adjacent to said handle portion of said clip support member, said handle portion of said clip support member being a plate being angled relative to said secondary tubular portion and having a tapered outer end;

a clip member being pivotally attached to said clip support member and having a curved fastening portion which is pivotally disposed about said main tubular portion and also having a handle portion, said clip member further including lug members being spaced apart and being attached at a bottom end of said handle portion of said clip member, said handle portion of said clip member being a plate having an enlarged outer end with a planar first side and a bulbous second side; and a biasing assembly being connected to said clip support member and to said clip member for biasing said curved fastening portion of said clip member upon said main tubular portion of said clip support member, said biasing assembly including at least one shaft being disposed through said secondary tubular portion and in said lug members, and also including spring members being disposed about said at least one shaft and being engaged to said handle portion of said clip member for biasing said curved fastening portion about said main tubular portion to hold a portion of a towel therebetween.

* * * * *